US012678908B2

(12) United States Patent
Herman et al.

(10) Patent No.: US 12,678,908 B2
(45) Date of Patent: Jul. 14, 2026

(54) METHOD OF PREPARING A MEAT SKINNER BLADE AND MEAT SKINNER BLADE PREPARED THEREBY

(71) Applicant: AccuTec, Inc., Verona, VA (US)

(72) Inventors: Randall N. Herman, Waynesboro, VA (US); Micah D. Herron, Waynesboro, VA (US); Samuel L. Simmons, Bridgewater, VA (US); Frank Henry Prochaska, Waynesboro, VA (US)

(73) Assignee: Accutec, Inc., Verona, VA (US)

( * ) Notice: Subject to any disclaimer, the term of this patent is extended or adjusted under 35 U.S.C. 154(b) by 456 days.

(21) Appl. No.: 17/324,531

(22) Filed: May 19, 2021

(65) Prior Publication Data

US 2021/0362283 A1 Nov. 25, 2021

Related U.S. Application Data

(60) Provisional application No. 63/028,652, filed on May 22, 2020.

(51) Int. Cl.
*B24B 3/36* (2006.01)
*B24B 3/48* (2006.01)

(52) U.S. Cl.
CPC ..... *B24B 3/366* (2013.01); *B24B 3/48* (2013.01); *B24B 3/485* (2013.01)

(58) Field of Classification Search
CPC B24B 3/36; B24B 3/361; B24B 3/366; B24B 3/56; B24B 3/48; B24B 3/485; B26B 21/56
USPC ..... 451/45, 192, 193
See application file for complete search history.

(56) References Cited

U.S. PATENT DOCUMENTS 1,370,381 A * 3/1921 Tarbox ..... B21D 53/645 144/144.1
2,697,951 A * 12/1954 Muller ..... B26B 21/56 30/346.55
3,461,616 A 8/1969 Nissen et al.
3,494,081 A * 2/1970 Rygh ..... B24B 3/485 451/45
3,566,854 A 3/1971 Nissen
4,265,055 A 5/1981 Cartwright et al.
(Continued)

FOREIGN PATENT DOCUMENTS

EP 1118437 A1 * 7/2001 ..... A22B 5/16
GB 1465858 A 3/1977

OTHER PUBLICATIONS

1 Extended European Search Report for European Application No. 21175103.7 dated Oct. 18, 2021.

*Primary Examiner* — Brian D Keller
*Assistant Examiner* — Marcel T Dion
(74) *Attorney, Agent, or Firm* — Budzyn IP Law, LLC

(57) ABSTRACT

In one aspect, a method of preparing a meat skinner blade is provided which includes: abrading an upper edge of a steel strip to form an angularly-offset two-facet blade edge; and, honing the two-facet blade edge of the steel strip to impart a vertical taper along the two facets of the two-facet blade edge. Advantageously, the subject invention provides a blade for meat skinning, de-membraning, and derinding having, in use, a downwardly-turned edge with vertical tapering. This provides for a robust design capable for more cuts, and, thus, longer use life, than standard meat skinner blades.

5 Claims, 11 Drawing Sheets

(56) References Cited

U.S. PATENT DOCUMENTS

| | | | | | |
|---|---|---|---|---|---|
| 4,606,093 | A * | 8/1986 | Townsend | A22C 17/12 | 99/589 |
| 4,608,782 | A * | 9/1986 | Chylinski | B24B 3/48 | 451/190 |
| 4,807,401 | A | 2/1989 | Atwater | | |
| 5,645,470 | A * | 7/1997 | Ludwig | B24B 37/00 | 451/527 |
| 6,113,470 | A * | 9/2000 | Marinack | B31F 1/14 | 451/65 |
| 6,860,796 | B2 * | 3/2005 | White | B24B 3/36 | 451/45 |
| 8,858,299 | B2 * | 10/2014 | Boelter | B24B 3/54 | 451/349 |
| 2005/0113003 | A1 * | 5/2005 | Mizek | B24B 3/60 | 451/45 |
| 2006/0276110 | A1 * | 12/2006 | Friel | B24B 3/54 | 451/260 |
| 2008/0188164 | A1 * | 8/2008 | Droese | B24B 19/001 | 76/82 |
| 2013/0324014 | A1 * | 12/2013 | Dovel | B24B 3/36 | 451/410 |

* cited by examiner

METHOD OF PREPARING A MEAT SKINNER BLADE AND MEAT SKINNER BLADE PREPARED THEREBY

CROSS-REFERENCE TO RELATED APPLICATION

This application claims priority to U.S. Provisional application No. 63/028,652, filed May 22, 2020, the entire contents of which are incorporated by reference herein.

FIELD OF THE INVENTION

The subject invention relates to preparation of meat skinner blades for food processing facilities.

BACKGROUND OF THE INVENTION

Meat skinner blades are known in the prior art for skinning, de-membraning, or derinding of animal skin and fat from various animals, including beef, pork, fish, and poultry. In large-scale meat processing plants, skinner and derinding machines are utilized which are configured to rotate a piece of meat against an exposed blade to separate the skin and/or fat of the piece of meat from the underlying muscle tissue. This allows for separate processing of the skin and fat, separate from the underlying remaining meat.

Meat skinner blades have been formed in the prior art with a chisel blade edge as shown in FIG. 1. As shown in FIG. 1, blade 1 includes a blade body 2 having a first facet 3 extending to a two-facet tip edge 4. The facets are all generally planar with the two-facet tip edge being symmetrically aligned about a vertical axis V which is parallel to a longitudinal axis L of the blade body 2. Meat skinner blades are used extensively during processing, resulting in dulling, and needing replacement.

Separately, techniques have been developed in the prior art for imparting vertical tapering to razor blade edges, as shown in U.S. Pat. Nos. 3,461,616, 3,566,854, 4,265,055, and 4,807,401, all of which are incorporated by reference herein. Vertical tapering, as shown in FIG. 2, imparts convexity to the facets of a blade edge. Standard flat grinding defines generally planar facets. With vertical tapering, convexity is imparted to the facets, thereby increasing the width of the blade edge away from the tip. This allows for greater durability for the blade edge generally without loss of sharpness.

SUMMARY OF THE INVENTION

In one aspect, a method of preparing a meat skinner blade is provided which includes: abrading an upper edge of a steel strip to form an angularly-offset two-facet blade edge; and, honing the two-facet blade edge of the steel strip to impart a vertical taper along the two facets of the two-facet blade edge. Advantageously, the subject invention provides a blade for meat skinning, de-membraning, and derinding having, in use, a downwardly-turned edge with vertical tapering. This provides for a robust design capable for more cuts, and, thus, longer use life, than standard meat skinner blades.

In a further aspect, a method of preparing a meat skinner blade is provided which includes: grinding an upper edge of a moving steel strip to form a single-facet blade edge; then, skewing the moving steel strip; then, honing the single-facet blade edge of the moving steel strip to form a two-facet blade edge; and, then, honing the two-facet blade edge of the moving steel strip to impart a vertical taper along the two facets of the two-facet blade edge.

As used herein, "meat skinner blades," in single or plural, shall include all blades suitable for skinning, de-membraning, or derinding skin or fat from a piece of meat during processing.

As used herein, "abrading," and derivates thereof, shall include all forms of dressing steel to form and/or sharpen a blade edge, including, but not limited to, grinding, honing, and, machining (e.g., milling).

These and other features of the subject invention will be better understood through a study of the following detailed description and accompanying drawings.

DETAILED DESCRIPTION OF THE INVENTION

Figure 1:
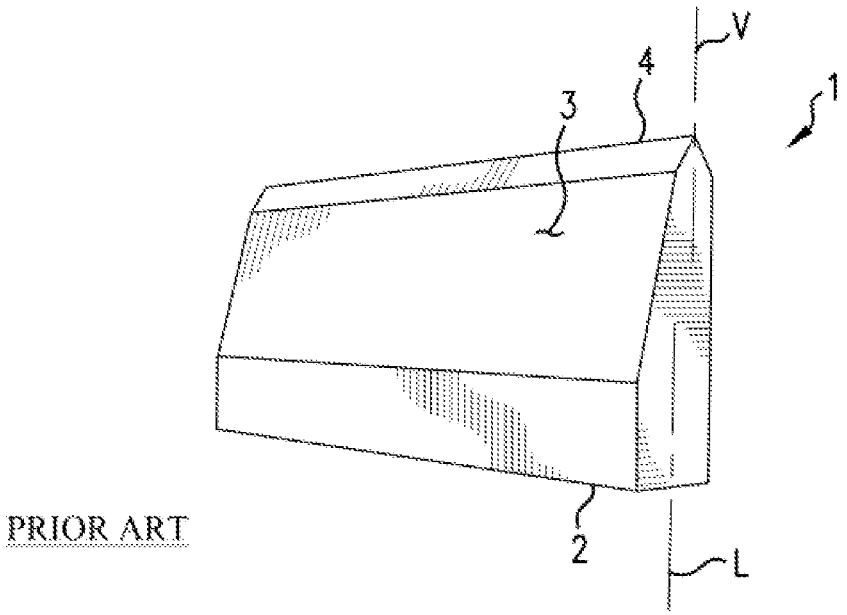
PRIOR ART FIG. 1
FIG. 1 shows a profile of a prior art chisel blade edge.
Figure 2:
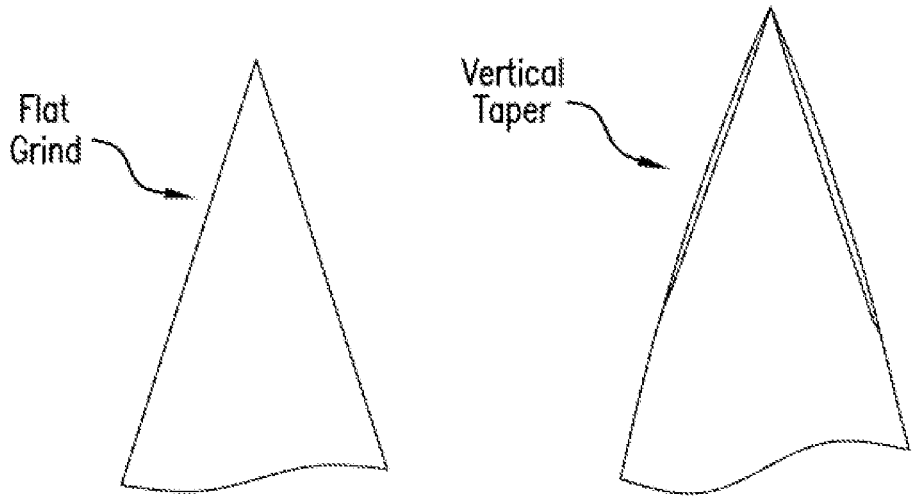
FIG. 2 shows flat ground facets compared with vertically tapered facets of a blade edge.
Figure 3:
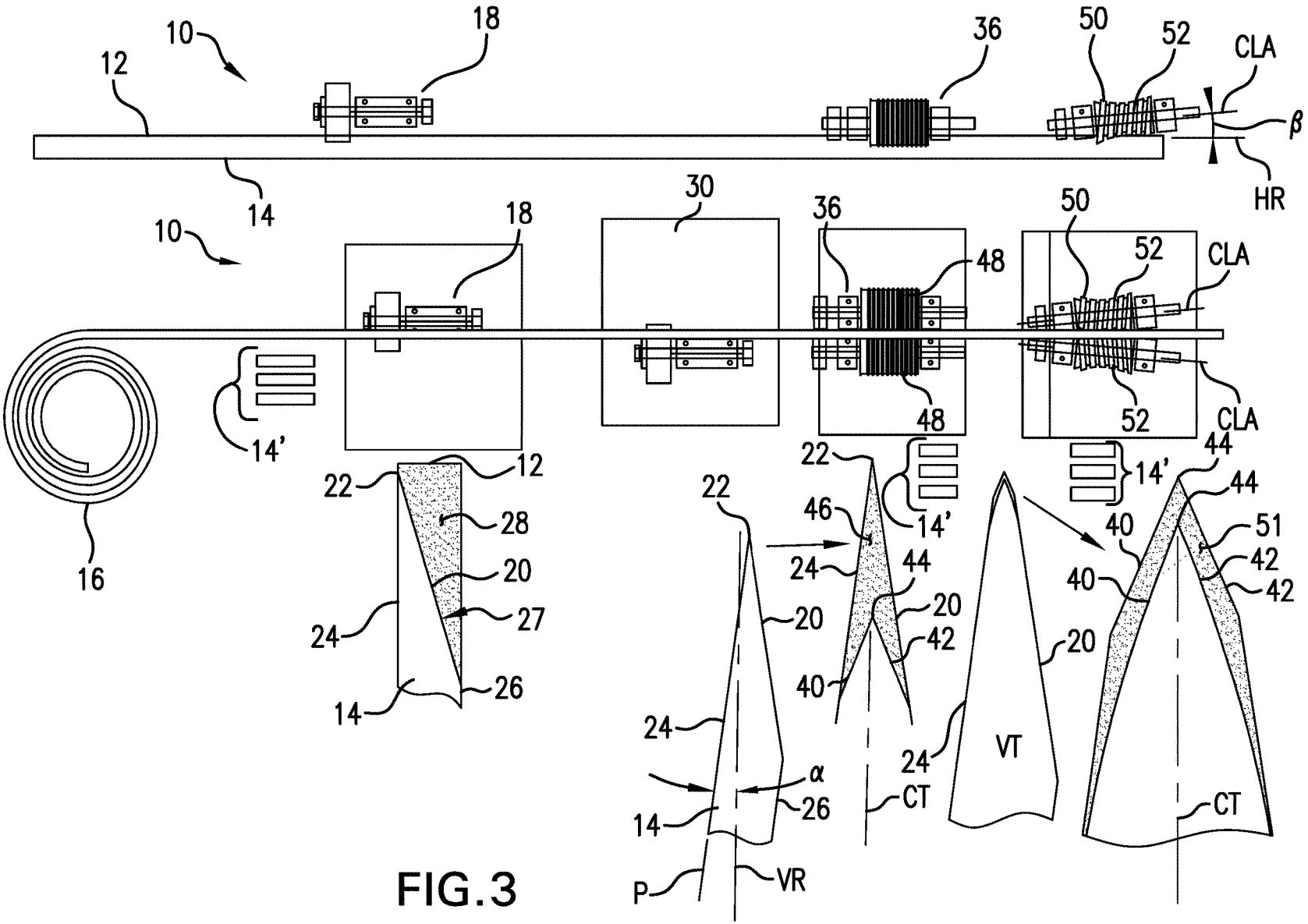
FIG. 3 shows a system in accordance with the subject invention.

With reference to FIG. 3, a system 10 is shown for forming meat skinner blades. The system 10 is configured to dress an upper edge 12 of a moving steel strip 14. The steel strip 14 may be initially coiled as coil 16, and decoiled therefrom as the process proceeds. The system 10 includes a plurality of stations through which the steel strip 14 is moved. The steel strip 14 is moved using any suitable arrangement, such as powered rollers.

The moving steel strip 14 is first caused to pass a grinding station 18. As shown in FIG. 3, the upper edge 12 is ground to form a single, first facet 20 which defines a tip 22 with first face 24. The first facet 20 extends from the tip 22 to second face 26 to define a single-facet blade edge 27. Material removed during this step is represented by shaded area 28.

The system 10 may optionally include one or more secondary grinding stations 30 to provide for additional material removal from the upper edge 12. Alternatively, the first facet 20 may be formed across multiple grinding stations (the grinding station 18, one or more of the secondary grinding stations 30) with each grinding station partially removing material to ultimately form the first facet 20. This may be desired where the amount of material desired for removal may not be reliably removed with a single pass across the grinding station 18.

Figure 4:
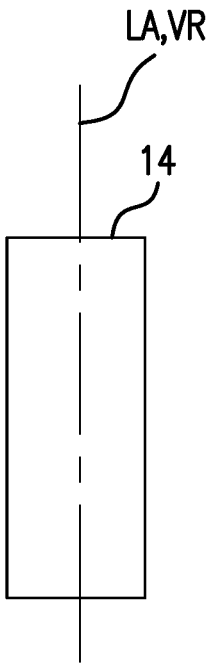
FIGS. 4-6 show schematically skewing useable with the subject invention.
Figure 5:
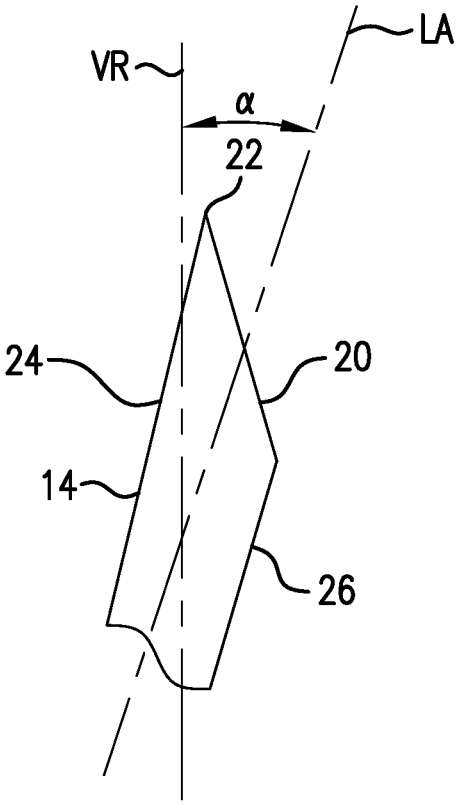

The moving steel strip 14 may be caused to move through grinding (the grinding station 18, one or more of the secondary grinding stations 30) with its longitudinal axis LA aligned with a reference vertical axis VR, as shown in FIG. 4. After grinding, and prior to honing, the moving steel strip 14 may be skewed so that the longitudinal axis LA is angularly offset by an angle $\alpha$ from the vertical axis VR, as shown in FIG. 5. The angle $\alpha$ may be in the range of 1-10 degrees, more preferably, in the range of 5-10 degrees, more preferably, in the range of 6-8 degrees. It is further preferred that, as shown in FIG. 5, the angular offset causes the first face 24 to intersect the vertical axis VR.

Figure 6:
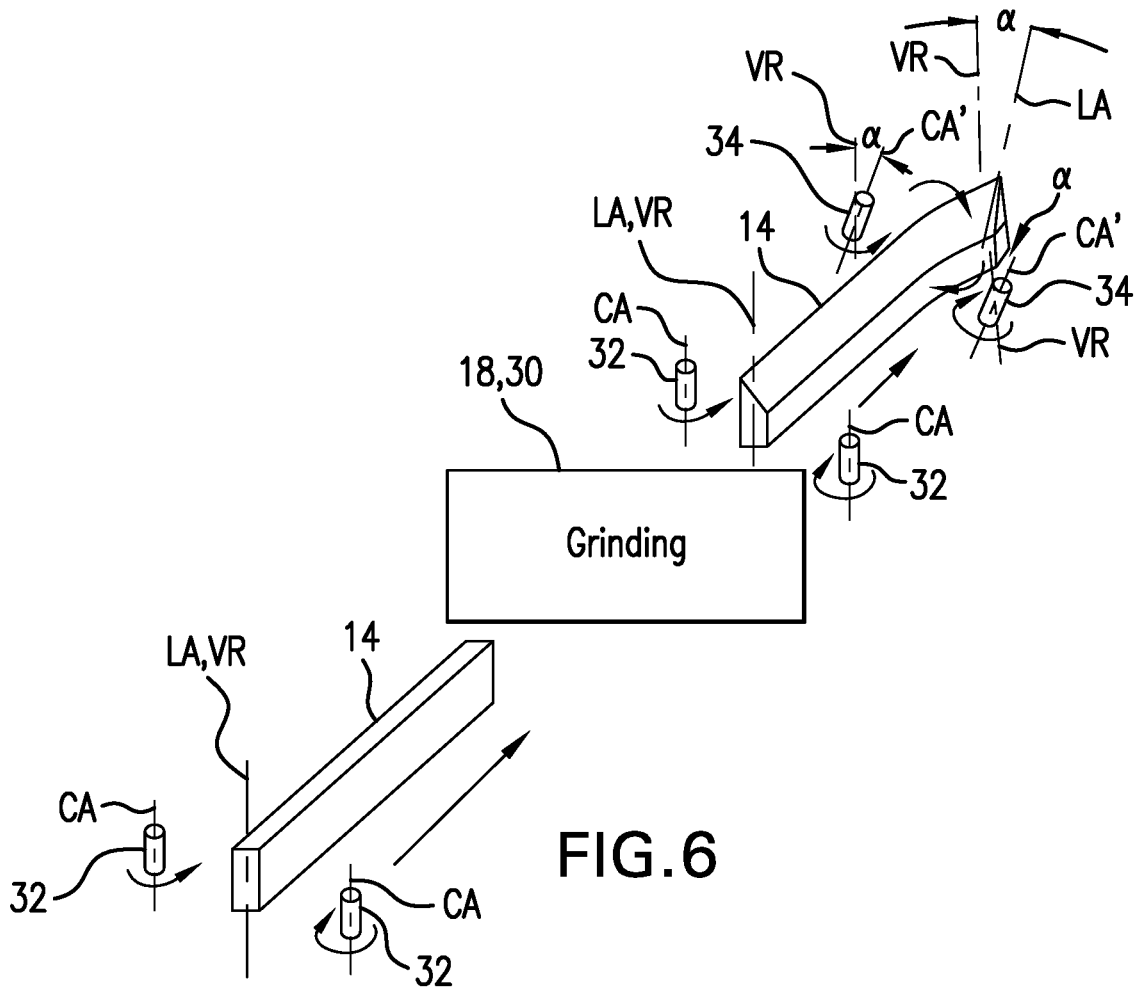

As an exemplary arrangement to achieve skewing, FIG. 6 schematically shows first rollers 32 located before and after grinding, the first rollers 32 having central longitudinal axes CA generally parallel to the reference vertical axis VR. This arrangement allows for the longitudinal axis of the moving steel strip 14 to be aligned with the reference vertical axis VR. Second rollers 34 are provided downstream, prior to honing, which have central longitudinal axes CA' angularly offset to the reference vertical axis VR. The angular offset of the second rollers 34 causes the moving steel strip 14 to skew as described above. The second rollers 34 may be angularly offset by the angle α, within the same ranges as described above. The first and second rollers 32, 34 may be motor driven as is known in the art.

With the moving steel strip 14 being skewed, as shown in FIG. 3, the moving steel strip 14 is caused to pass through a first honing station 36, where the first facet 20 and the first face 24 are honed about the tip 22 to remove portions of the first facet 20 and the first face 24, including the tip 22, to form a two-facet blade edge 38 with second facet 40 and third facet 42. Material removed during this step is represented by second shaded area 46. The second facet 40 extends from newly-formed secondary tip 44 to the first face 24, with the third facet 42 extending from the secondary tip 44 to the first facet 20. The first honing station 36 is configured to symmetrically hone about a vertical axis HA parallel to the reference vertical axis VR. Thus, the second facet 40 and the third facet 42 are symmetrically arranged about a central axis CT passing through the secondary tip 44, which is angularly offset from the longitudinal axis LA of the moving steel strip. With the first honing station 36 being configured to symmetrically hone about the vertical axis HA, the central axis CT shall be angularly offset by the angle α from the longitudinal axis LA. Preferably, the central axis CT is disposed to intersect a plane P coincident with the first face 24 with the secondary tip 44 being directed towards the same plane P. This provides the two-facet blade edge 38 with an angularly offset orientation directed generally in the same direction as the direction faced by the first face 24.

The first honing station 36 may include two honing wheels 48 arranged to define a nip through which the moving steel strip 14 passes. The honing wheels 48 may be arranged in parallel. Any honing wheel arrangement capable of forming the two-facet blade edge 38 may be utilized.

The system 10 further includes a second honing station 50 for imparting vertical tapering to the second and third facets 40, 42 of the two-facet blade edge 38. Material removed during this step is represented by shaded area 51. The second honing station 50 includes second honing wheels 52 which are intermeshed to define a central nip symmetrically aligned with the vertical axis HA. The angular orientation of the moving steel strip 14 is maintained after the first honing station 36 to the second honing station 50. This allows the central axis CT to be aligned with the vertical axis HA to permit the second honing wheels 52 to symmetrically hone the two-facet blade edge 38 about the central axis CT.

Figure 7:
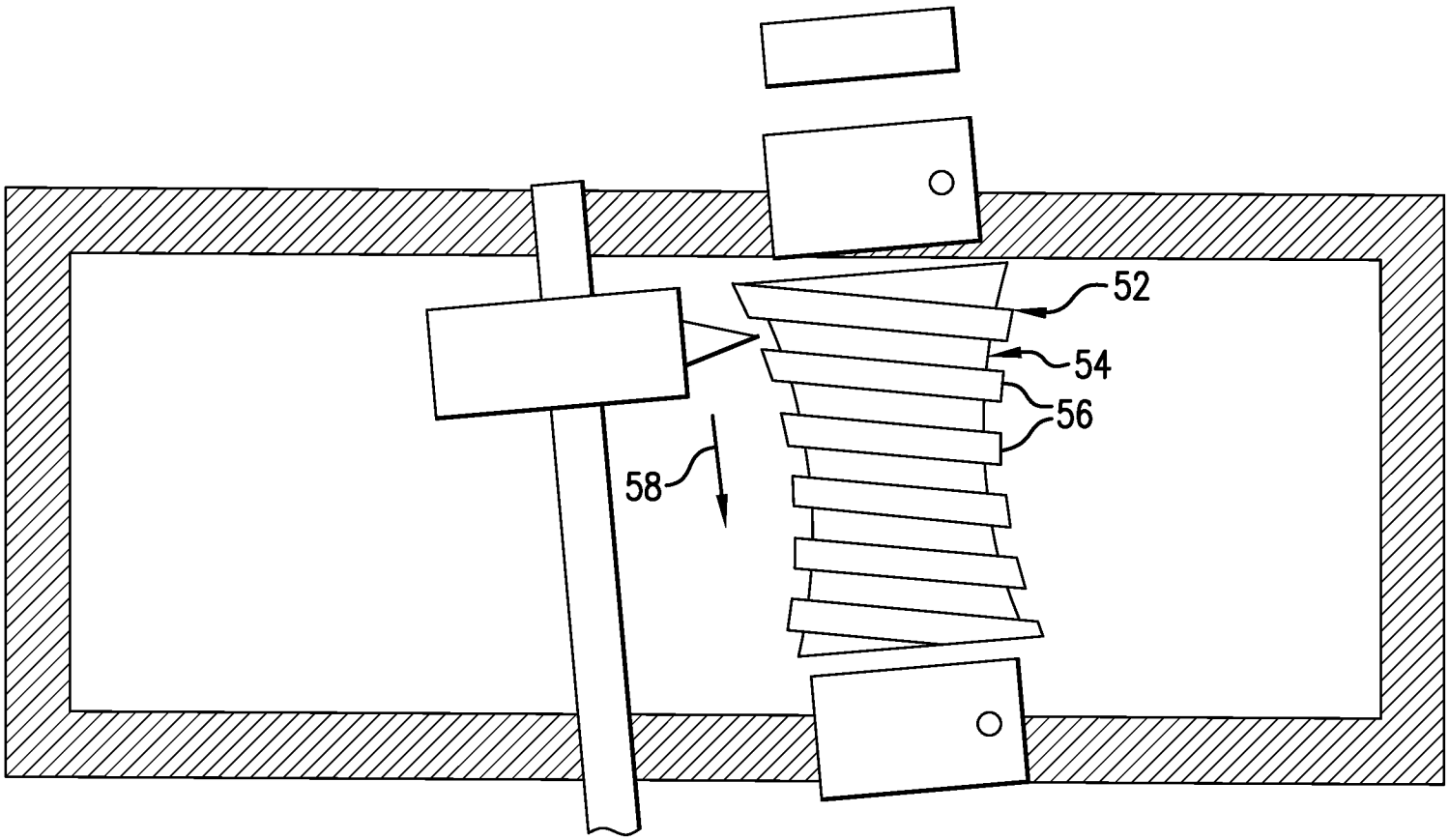
FIG. 7 shows a honing wheel useable with the subject invention for imparting vertical tapering; and, FIGS. 8-14 show a profile, and aspects thereof, of a meat skinner blade formed in accordance with the subject invention.

The second honing wheels 52 may be formed in accordance with any of U.S. Pat. Nos. 3,461,616, 3,566,854, 4,265,055, and 4,807,401. As shown in FIG. 7, the second honing wheels 52 may each include a helical groove 54 which forms spaced-apart spiral lands 56. The helical grooves 54 allow for the intermeshing of the second honing wheels 52. In addition, the diameters of the spiral lands 56 may vary in the direction of movement of the moving steel strip 14, such direction being represented by arrow 58. It is preferred that the diameters of the spiral lands 56 be arranged to define an overall concave shape for each of the second honing wheels 52. The concave shape contributes in imparting convexity to the second and third facets 40, 42 in providing vertical tapering.

The second honing wheels 52 may have central longitudinal axes CLA which are not parallel. Preferably, as shown in FIG. 3, the central longitudinal axes CLA may be disposed to diverge in direction of movement of the moving steel strip 14. In addition, relative to perpendicular plane, the central longitudinal axes CLA may be angularly disposed to raise rears 60, relative to fronts 62, of the second honing wheels 52. Relative to a reference horizontal axis HR, the central longitudinal axes CLA may be disposed at an angle β in the range of 1-10 degrees, more preferably, 3-7 degrees. This arrangement allows for less contact between the moving steel strip 14 and the second honing wheels 52 with movement of the moving steel strip 14, thus, decreasing the amount of honing with passage through the second honing station 50.

After the second honing station 50, various processes may be included with the system 10 including heat treating, tempering, singulating into individual blades, and/or coiling into a secondary coil for further processing.

As will be understood by those skilled in the art, the subject invention may be practiced utilizing a non-moving steel strip 14. Here, lengths of the steel strip 14 may be dressed by the same processes as described above, but with the lengths of steel strip 14 being transported between stations, e.g., by cart, conveyor belt, etc. As shown in FIG. 3, the steel strip 14 is shown as discrete lengths of steel strip designated as 14'. The lengths 14' are subject to grinding (the grinding station 18, one or more of the secondary grinding stations 30) and honing (he first honing station 36, the second honing station 50) in the same sequence and manner as described above. The lengths 14' are honed at the angle α to obtain the same profiles as described above. The lengths 14' may be guided by one or more jigs in being fed at an angle into the nip of the first honing station 36 and, separately, into the nip of the second honing station 50, providing for the angle α during honing. It is possible to separate the process into continuous processing, e.g., utilizing the moving steel strip 14 through grinding, with the steel strip 14 being cut into the lengths 14' and passed through honing. Other variations are possible, e.g., where grinding and partial honing (e.g., the first honing station 36) are continuous processes acting on the moving steel strip 14, with the cut lengths 14' passing through the second honing station 50.

Further, as one skilled in the art will appreciate, in addition to the disclosure above, any mode or modes of abrading may be utilized to dress the upper edge of the steel strip 14, 14' (whether moving or not) to form the angularly-offset two-facet blade edge 38. The two-facet blade edge 38, thus formed, may be subjected to vertical tapering by the second honing station 50.

Figure 8:
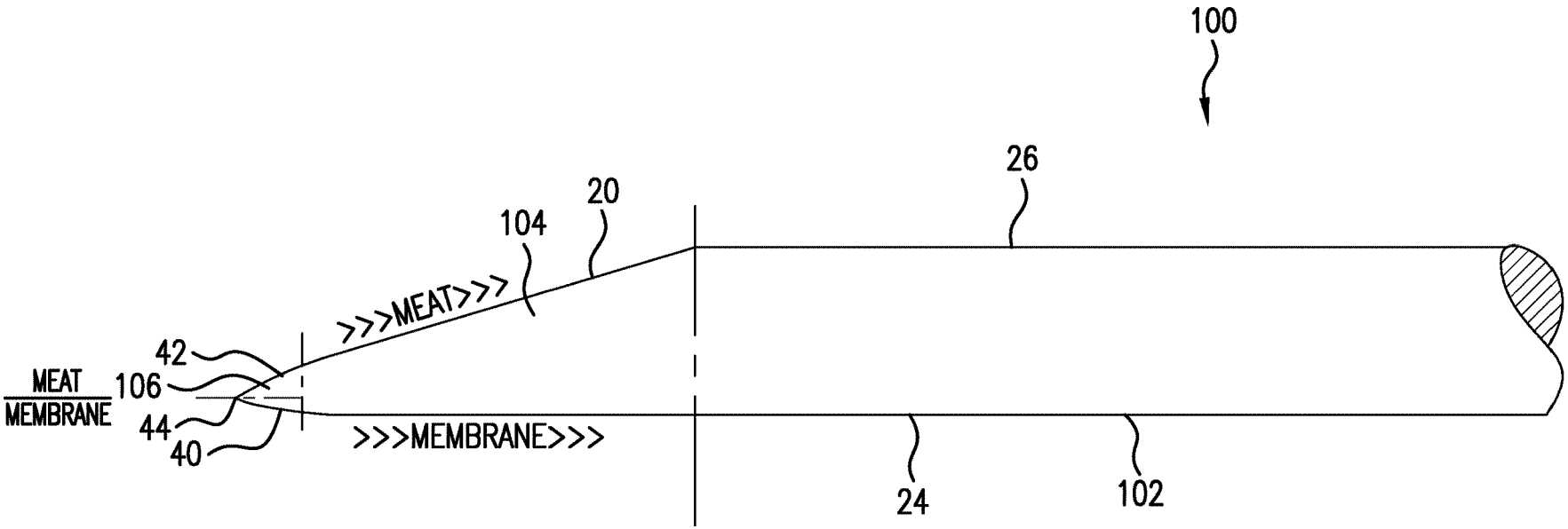
Figure 9:
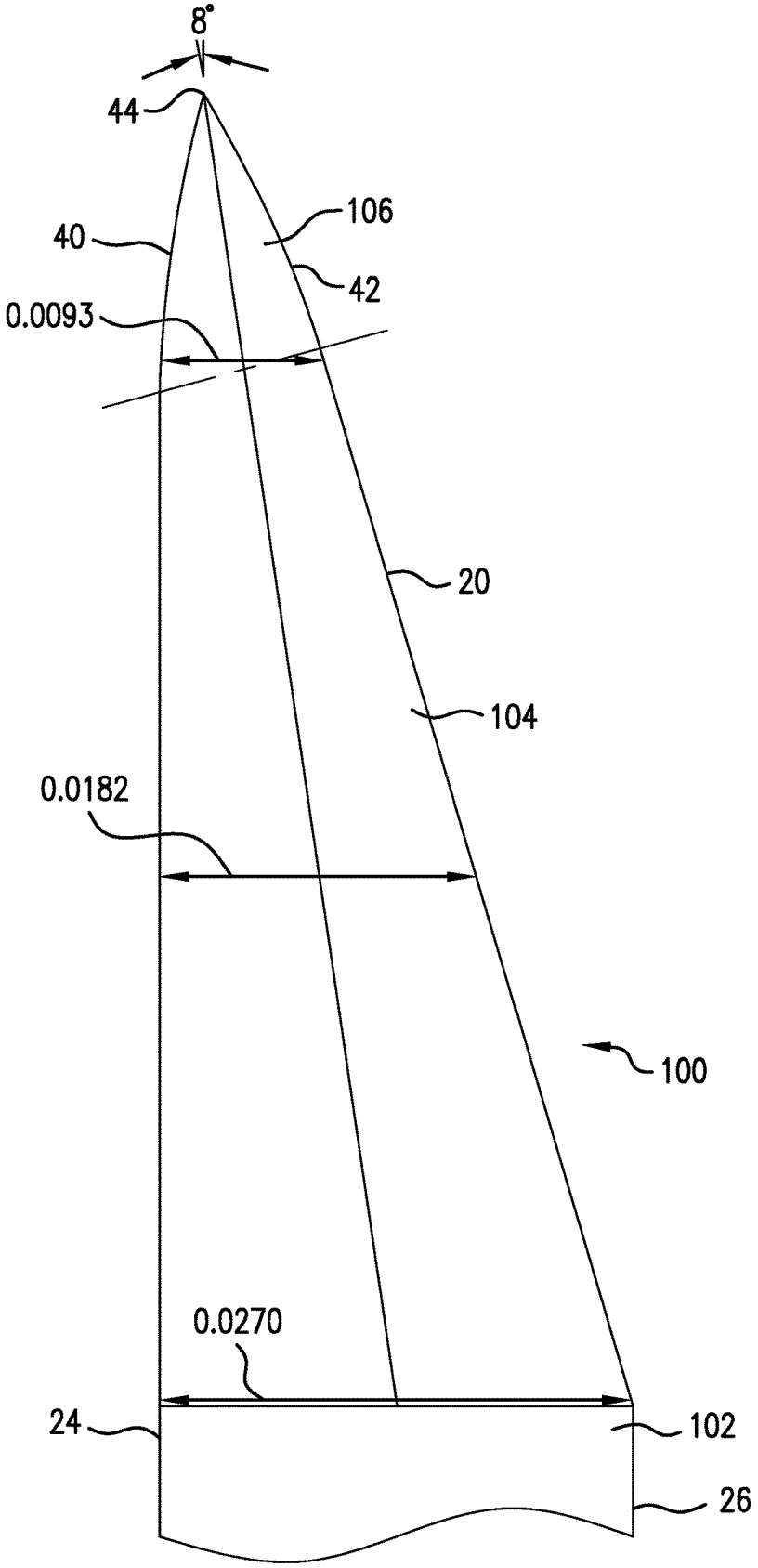
Figure 10:
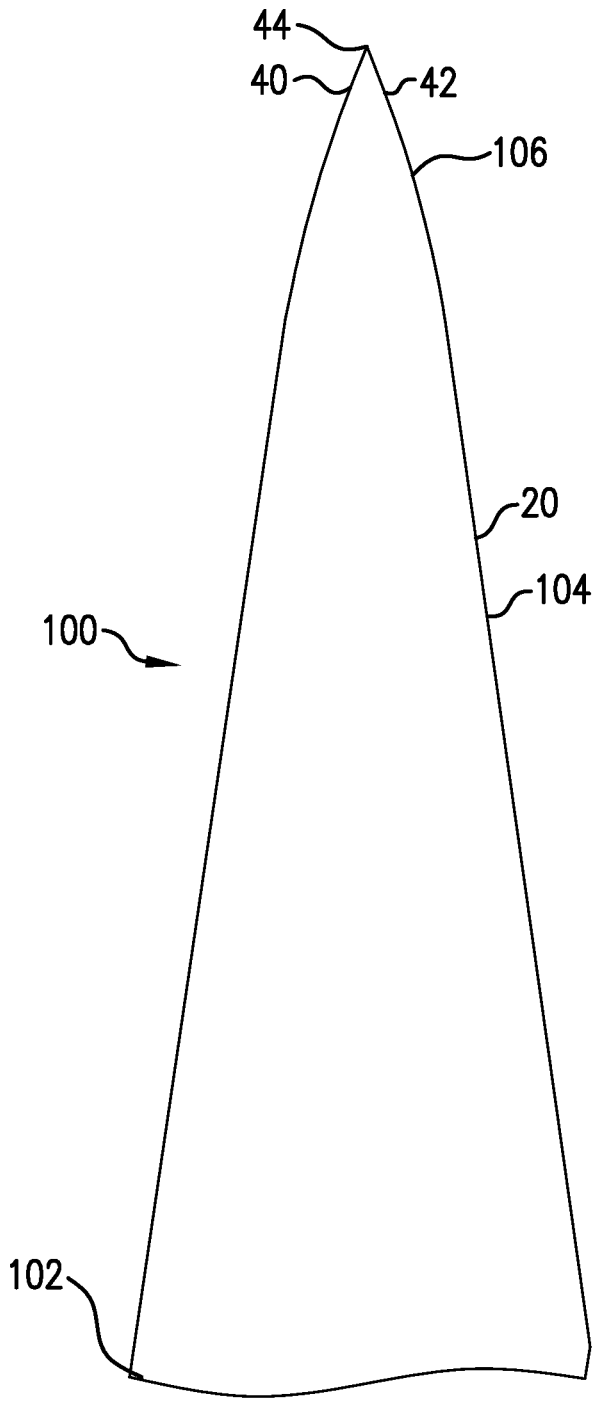

With reference to FIG. 8, the profile of a meat skinner blade 100 is shown formed in accordance with the subject invention. The meat skinner blade 100 includes a body 102 defined between the first and second faces 24, 26 from which extends an intermediate portion 104, which is coextensive with the first facet 20. A tip portion 106 extends from the intermediate portion 104 to the secondary tip 44, the tip portion 106 being coextensive with the vertically-tapered second and third facets 40, 42. As shown in FIG. 9, the tip portion 106 is angled downwardly (extend through a plane of the first face 24). This allows for improved separation of meat from animal skin or fat during use.

As shown in FIG. 9, the second and third facets 40, 42 are of limited length relative to the first facet 20, thus, providing the tip portion 106 with a limited length relative to the profile of the meat skinner blade 100. The length of the intermediate portion 104 and/or the tip portion 106 may be varied depending on the thickness of the body 102. The tip portion 106 may vary in length between 0.01"-0.05", more preferably ranging between 0.01"-0.035".

Figure 11:
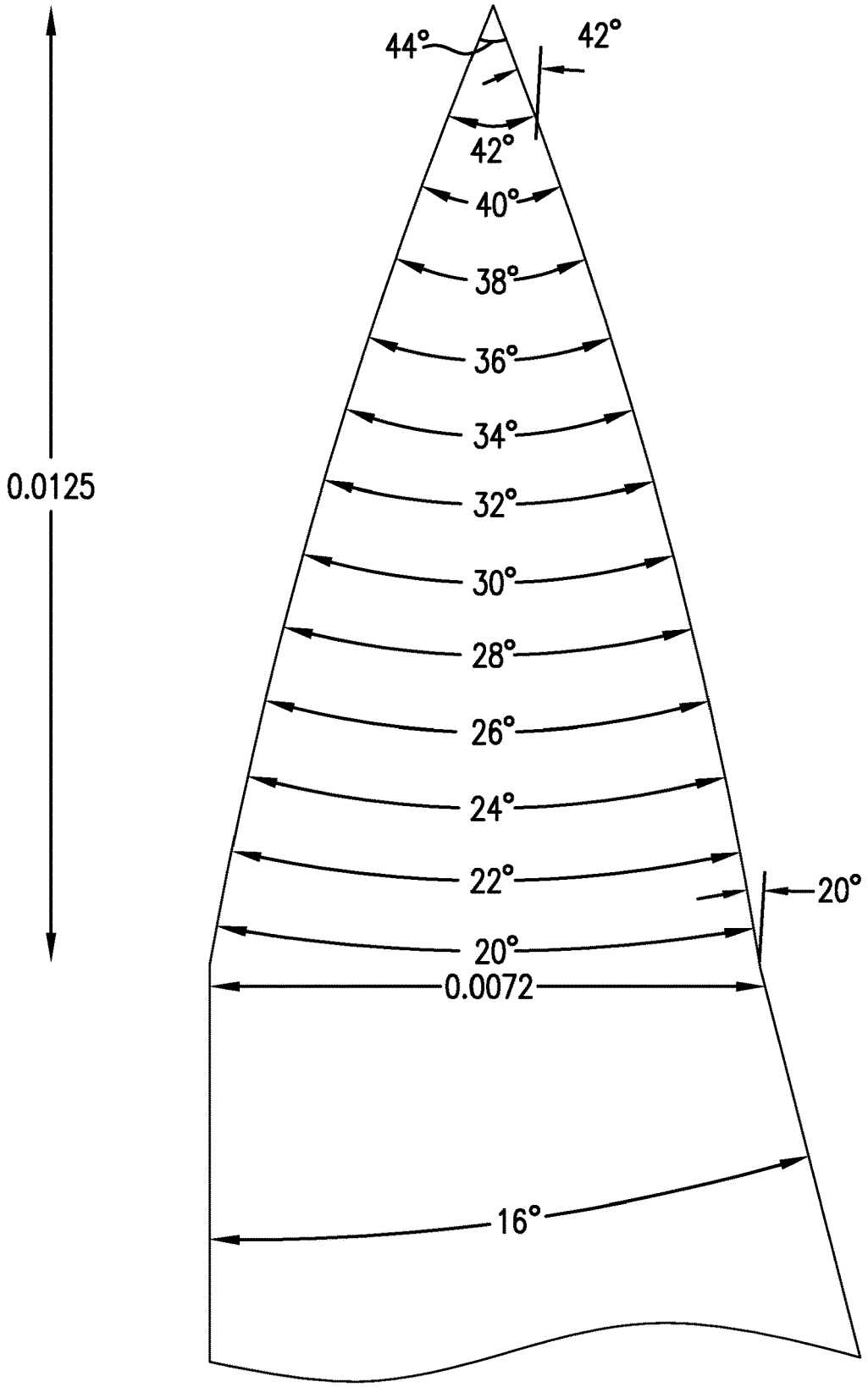
Figure 12:
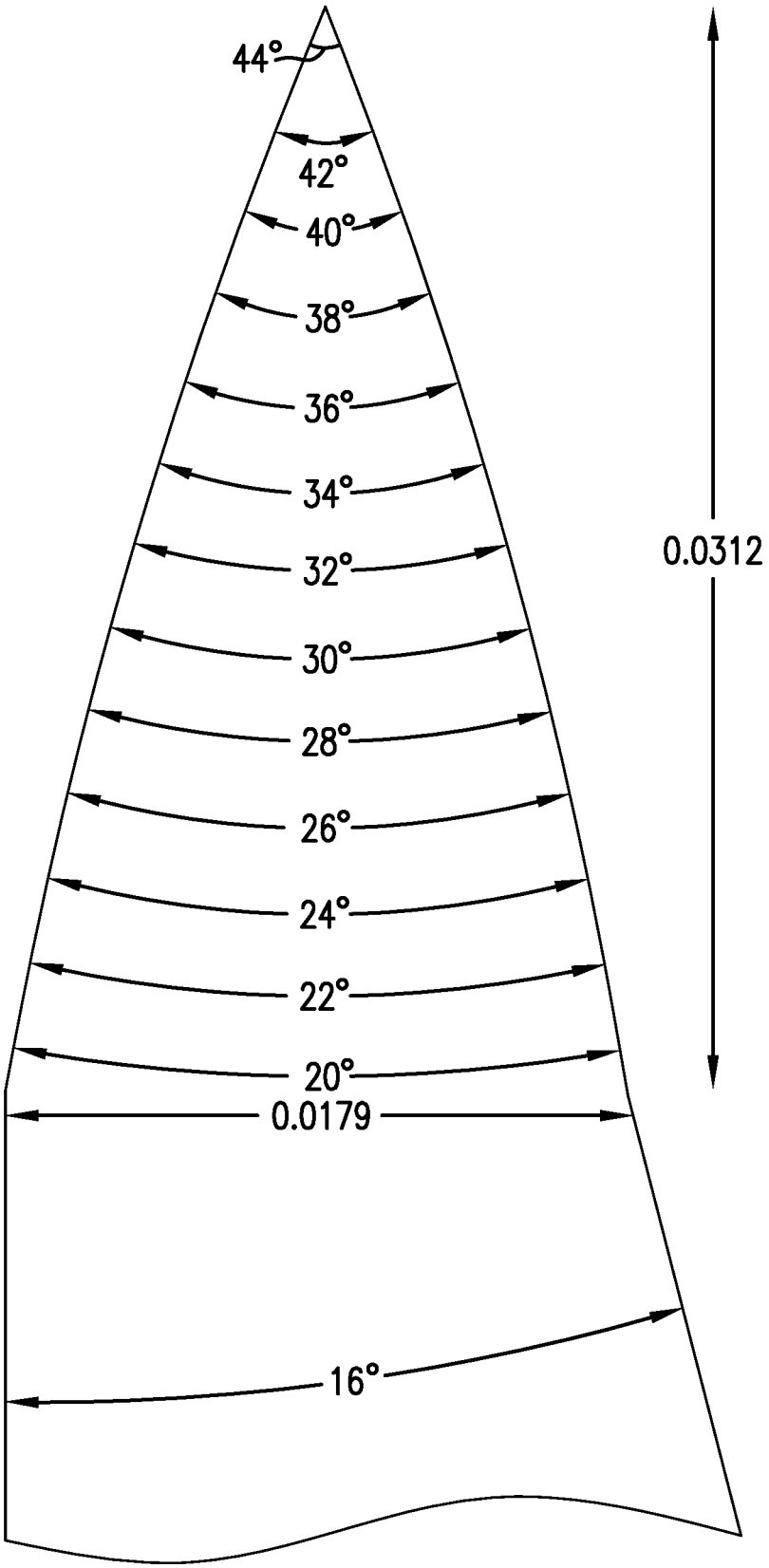

The vertical tapering of the second and third facets 40, 42 may define surfaces which have a continuous angular change. As shown in FIGS. 11 and 12, the second and third facets 40, 42 may define angles in the range of 20 degrees-44 degrees along the length of the tip portion 106. The angles are defined as tangents along the second and third facets 40, 42, as shown representatively in FIG. 11. In contrast, the first and second faces 24, 26 may subtend an acute angle in the range of 10 degrees-20 degrees, shown as 16 degrees in FIG. 11.

Figure 13:
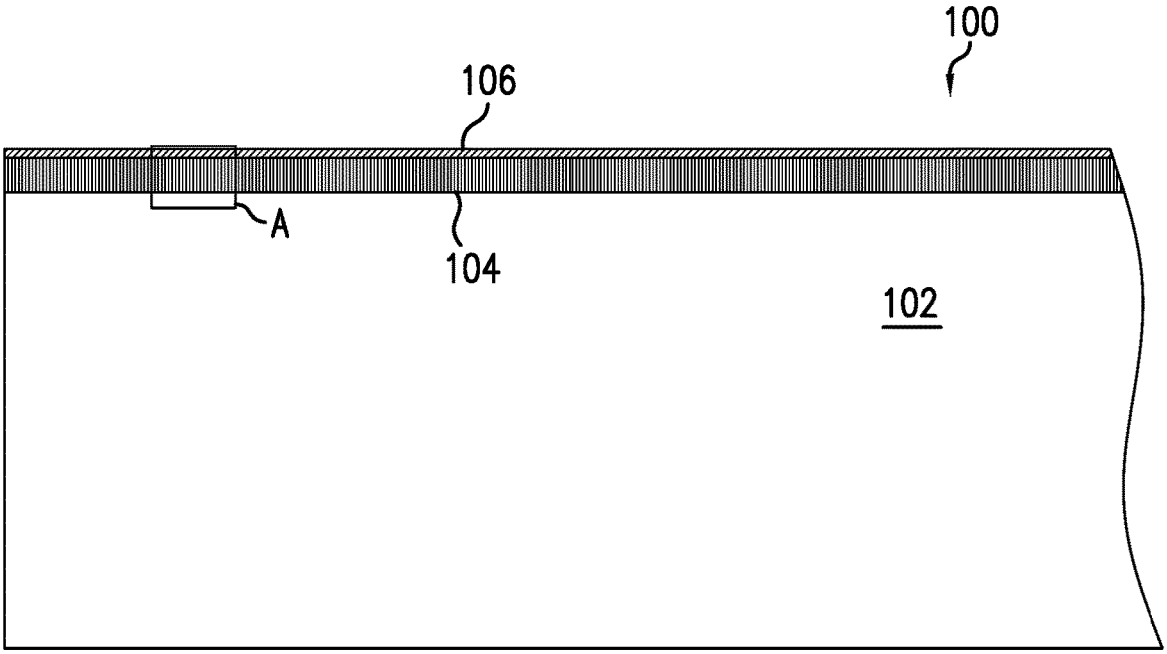
Figure 14:
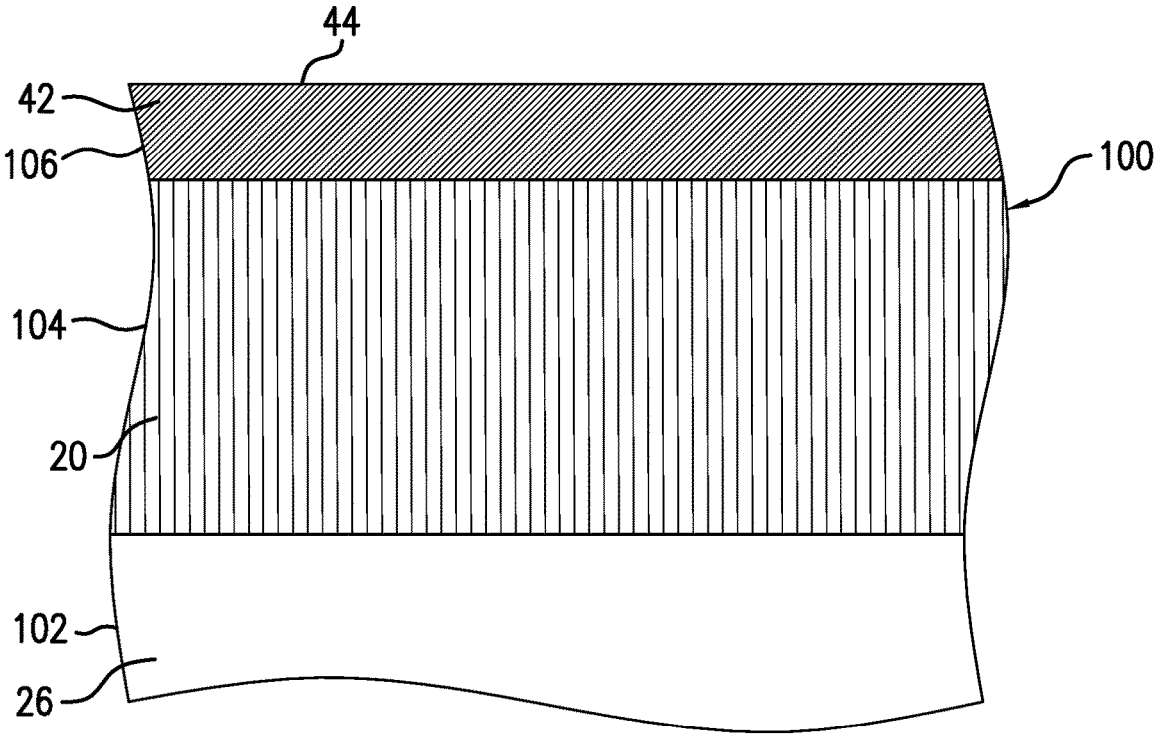

As shown in FIGS. 13 and 14, the intermediate portion 104 may include a striated surface, particularly along the first facet 20. The striations may be tool marks resulting from grinding. As shown in FIG. 14, the tip portion 106, as a result of honing, may have also tool marks, which would be disposed at an angle relative to the striations of the intermediate portion 104.

What is claimed is:

1. A method of preparing a meat skinner blade, the method comprising:

grinding an upper edge of a moving steel strip to form a single-facet blade edge, wherein the moving steel strip includes opposing first and second faces, the single-facet blade edge being formed between the first and second faces, wherein the moving steel strip is elongated to extend along a longitudinal axis, the longitudinal axis lying in a longitudinal plane which extends along the steel strip and which is spaced from both the first and second faces, the longitudinal plane being coplanar with a reference vertical plane during the grinding; then, skewing the moving steel strip relative to the reference vertical plane so that the longitudinal plane is angularly offset from the reference vertical plane so that the reference vertical plane intersects the first face, wherein the skewing the moving strip is achieved by passing the moving steel strip through a set of rollers which are angularly offset from the reference vertical plane; then, at a first honing station, honing the single-facet blade edge of the moving steel strip to form a two-facet blade edge; and, then, at a second honing station, honing the two-facet blade edge of the moving steel strip to impart a vertical taper along the two facets of the two-facet blade edge, wherein, the second honing station is spaced from the first honing station with the moving steel strip moving to the second honing station after exiting from the first honing station.

2. A method as in claim 1, wherein the skewing the moving steel strip includes angularly offsetting the longitudinal plane of the moving steel strip an angle in the range of 1-10 degrees from the vertical reference plane.

3. A method as in claim 2, wherein the honing the two-facet blade edge of the moving steel strip to impart a vertical taper along the two facets of the two-facet blade edge includes:

moving the steel strip through a nip defined by two intermeshed honing wheels.

4. A method as in claim 3, wherein each of the honing wheels includes a helical groove defined therein, the helical groove forming spaced-apart spiral lands, wherein the diameter of the spiral lands vary in the direction of movement of the moving steel strip.

5. A method as in claim 4, wherein the diameters of the spiral lands vary in the direction of movement of the moving steep strip to define a concave shape along the respective honing wheel.

* * * * *